US011849863B2

(12) United States Patent
Torosian et al.

(10) Patent No.: US 11,849,863 B2
(45) Date of Patent: Dec. 26, 2023

(54) PORTABLE CRIB TO SUPPORT FULL-SIZE MATTRESS

(71) Applicant: Baby Delight, Inc., Cumberland, RI (US)

(72) Inventors: Steve Torosian, York, ME (US); Mark Adamowicz, Sutton, MA (US); Jason P. Macari, Cumberland, RI (US)

(73) Assignee: BABY DELIGHT, INC., Cumberland, RI (US)

( * ) Notice: Subject to any disclaimer, the term of this patent is extended or adjusted under 35 U.S.C. 154(b) by 132 days.

(21) Appl. No.: 17/185,832

(22) Filed: Feb. 25, 2021

(65) Prior Publication Data

US 2021/0274946 A1 Sep. 9, 2021

Related U.S. Application Data

(60) Provisional application No. 62/981,497, filed on Feb. 25, 2020.

(51) Int. Cl.
*A47D 13/06* (2006.01)
*A47D 7/00* (2006.01)
(Continued)

(52) U.S. Cl.
CPC ..... *A47D 13/063* (2013.01); *A47D 7/002* (2013.01); *A47D 9/016* (2022.08); *A47D 13/06* (2013.01);
(Continued)

(58) Field of Classification Search
CPC .. A47D 15/001; A47D 13/063; A47D 11/007; A47D 13/00; A47D 13/06;
(Continued)

(56) References Cited

U.S. PATENT DOCUMENTS 6,510,570 B2 * 1/2003 Hartenstine ..... A47D 13/063 5/98.1
7,013,505 B2 * 3/2006 Martin ..... A47D 7/02 5/98.1
(Continued)

FOREIGN PATENT DOCUMENTS

DE 19519119 A1 * 5/1996 ..... A47D 13/063
GB 2353947 * 3/2001 ..... A47D 15/00

OTHER PUBLICATIONS

Crib Mattresses—Common Questions About Measurements. Crib Mattresses, Furniture.com, Aug. 24, 2016, https://www.furniture.com/kids/nursery/crib-mattresses. (Year: 2016).*
(Continued)

*Primary Examiner* — Justin C Mikowski
*Assistant Examiner* — Madison Emanski
(74) *Attorney, Agent, or Firm* — Grossman, Tucker, Perreault Pfleger, PLLC

(57) ABSTRACT

A portable crib including a full-size crib mattress having an upper and a lower surface and a frame configured to be covered by the fabric cover to define crib sidewalls. The frame includes a collapsible top assembly including top rails, a collapsible bottom assembly including support rails to support the crib mattress, and a perimeter frame at least partially surrounded by the fabric cover to define at least a portion of the crib sidewall to surround the crib mattress and disposed between the upper and lower surfaces of the crib mattress at a predefined horizontal distance between an outer perimeter of the crib mattress and the perimeter frame.

16 Claims, 5 Drawing Sheets

(51) Int. Cl.

| | |
|---|---|
| ***A47D 9/00*** | (2006.01) |
| ***A47D 11/00*** | (2006.01) |
| ***A47D 15/00*** | (2006.01) |
| *A47D 5/00* | (2006.01) |

(52) U.S. Cl.
CPC ..... *A47D 13/061* (2013.01); *A47D 15/001* (2013.01); *A47D 11/005* (2013.01)

(58) Field of Classification Search
CPC .. A47D 13/061; A47D 13/066; A47D 13/068; A47D 7/002; A47D 7/005; A47D 11/005; A47D 7/02; A47D 7/00; A47D 9/005
See application file for complete search history.

(56) References Cited

U.S. PATENT DOCUMENTS

| | | | | |
|---|---|---|---|---|
| 2014/0075670 | A1* | 3/2014 | Crumrine | A47D 9/005 256/25 |
| 2016/0058203 | A1* | 3/2016 | Yaacoby | A47D 15/003 5/722 |
| 2020/0046141 | A1* | 2/2020 | Mu | A47D 9/00 |

OTHER PUBLICATIONS

"Cooperation." Dictionary.com, www.dictionary.com/browse/cooperation.*
"Surround." Merriam-Webster, Merriam-Webster, www.merriam-webster.com/dictionary/surround.*
"Horizontal." Merriam-Webster, Merriam-Webster, www.merriam-webster.com/dictionary/horizontal.*

* cited by examiner

PORTABLE CRIB TO SUPPORT FULL-SIZE MATTRESS

RELATED APPLICATIONS

The present application claims the benefit of U.S. Provisional Patent Application Ser. No. 62/981,497 filed on Feb. 25, 2020, which is fully incorporated herein by reference.

TECHNICAL FIELD

The present disclosure relates to portable cribs and play yards, and more particularly, to a portable crib with fabric/mesh sidewalls and an integrated perimeter frame that allows for use of full-size crib mattress.

BACKGROUND INFORMATION

Cribs are traditionally cumbersome to set up and are often not easy to move from room to room once set up. Traditional play yards offer portability but do not accept full size crib mattress or anything thicker than 1.5" for safety reasons.

DETAILED DISCLOSURE

Figure 1:
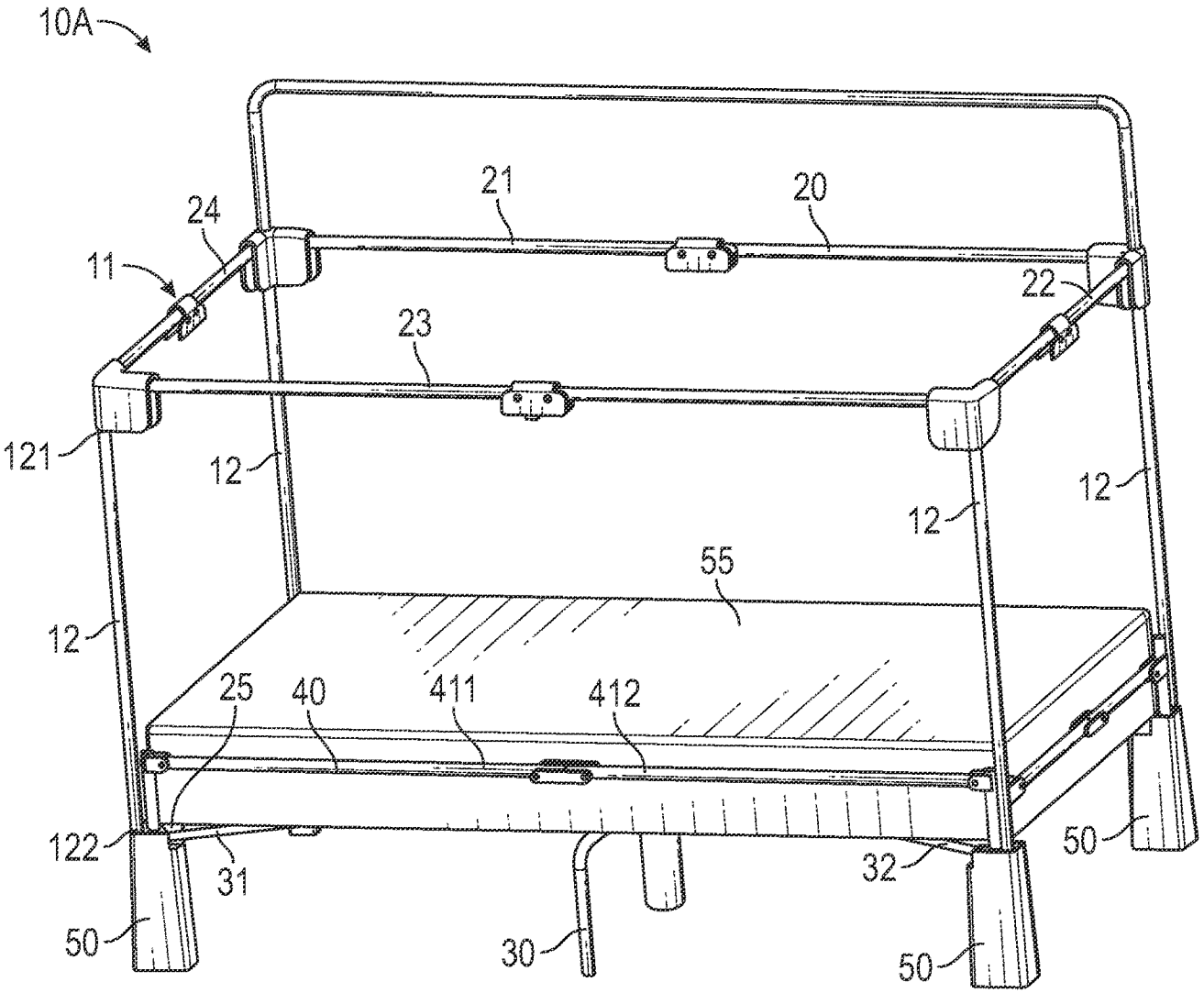
FIG. 1 shows an example portable play yard in accordance with aspects of the present disclosure.

In general, the following disclosure is directed to a play yard (or crib) that features a foldable tubular frame configured to accept and support a full-size crib mattress and surround the same with breathable mesh panels. In more detail, the size of cribs (and supporting frames, also referred to as an internal concentric frames) is generally mandated by standards such as ASTM F1169 titled Full Size Baby Crib standard. In addition, mattress sizes are also mandated. Such mandates generally seek to limit maximum allowed gap that exists between the edge of a mattress and the frame defining the crib walls. A full size crib mattress is defined by the CPSC as: 27¼ inches×51¼ inches, with a thickness not exceeding 6 inches.

One method of testing "gap" between such full size crib mattresses and adjacent/surrounding frame, e.g., a perimeter frame, includes verifying a so-called "torso" probe cannot pass between the mattress and the surrounding frame. The torso probe includes a width that approximates a baby/infant's body/torso. The maximum gap is, for instance, about 3.3" before the torso probe can pass between mattress and surrounding frame. Thus, as generally referred to herein, a maximum gap refers to a gap of 3.3" or less, and preferably 3" or less. Other maximum gaps (e.g., less than 2", 1", and so on) can be achieved with minor modification, and this disclosure is not intended to be limited in this regard.

A "torso" probe should not pass between the surrounding bedrail structure trapped in the fabric and the mattress. One such probe is defined in ASTM F1821-19.

In view of the aforementioned mandates, full-size mattress do not get utilized within foldable play yards and the like. Foldable play yards generally feature fabric/mesh sidewalls that 'stretch' and deform, which would introduce gaps between the sidewalls and the mattress. These gaps would unfortunately create a suffocation hazard. Accordingly, foldable play yards generally include a mattress-like insert that is no more than about 1.5 inches thick.

Thus, in accordance with an embodiment, a portable crib is disclosed that includes an outer frame (also referred to herein as simply a frame) formed from tubular members and an inner frame, also referred to herein as a perimeter frame, also formed of tubular frames for coupling to the outer frame and supporting a full size mattress. The portable crib further includes a fabric cover, a portion of which surrounds and captures tubular frame members of the perimeter frame. The fabric cover therefore provides flexible sidewalls while also significantly reducing the maximum gap between the same and the mattress.

In an embodiment, the outer and/or perimeter frame are configured to be decoupled from each other and separately foldable, or foldable/collapsible together as a single unit. Alternatively, or in addition, the outer and/or perimeter frame can be formed of multiple segments that telescope or otherwise removably couple together. In any such cases, the fabric cover can define one or more pockets/sections for receiving MDF or other suitably ridged material for increasing structural rigidity, and more importantly, reduce the potential for gaps between the sidewalls and full size mattresses.

Portable cribs/play yards consistent with the present disclosure include an in-use configuration whereby the same can support a full-size mattress and provide a safe sleeping environment for babies/infants. In addition, portable cribs/play yards consistent with the present disclosure include a storage configuration for storage and/or travel, and may be transitioned from the in-use configured to the storage configuration based on folding/collapsible frame members.

In one specific non-limiting example embodiment, a portable play yard to receive and support a full-size crib mattress is disclosed. The frame defining crib sidewalls when at least partially covered by a fabric cover, and the frame including support rails to underlie and support a full-size crib mattress. The full-size crib mattress is disposed on the support rails, and a perimeter frame coupled to the frame, the perimeter frame surrounding at least a portion of the full-size crib mattress. The perimeter frame coupled to the frame such that the perimeter frame is disposed at a predefined distance from the mattress to allow for breathability and prevent force, e.g., from an infant, being applied to sidewalls and introducing a gap between the sidewalls and the full size mattress.

Figure 6:
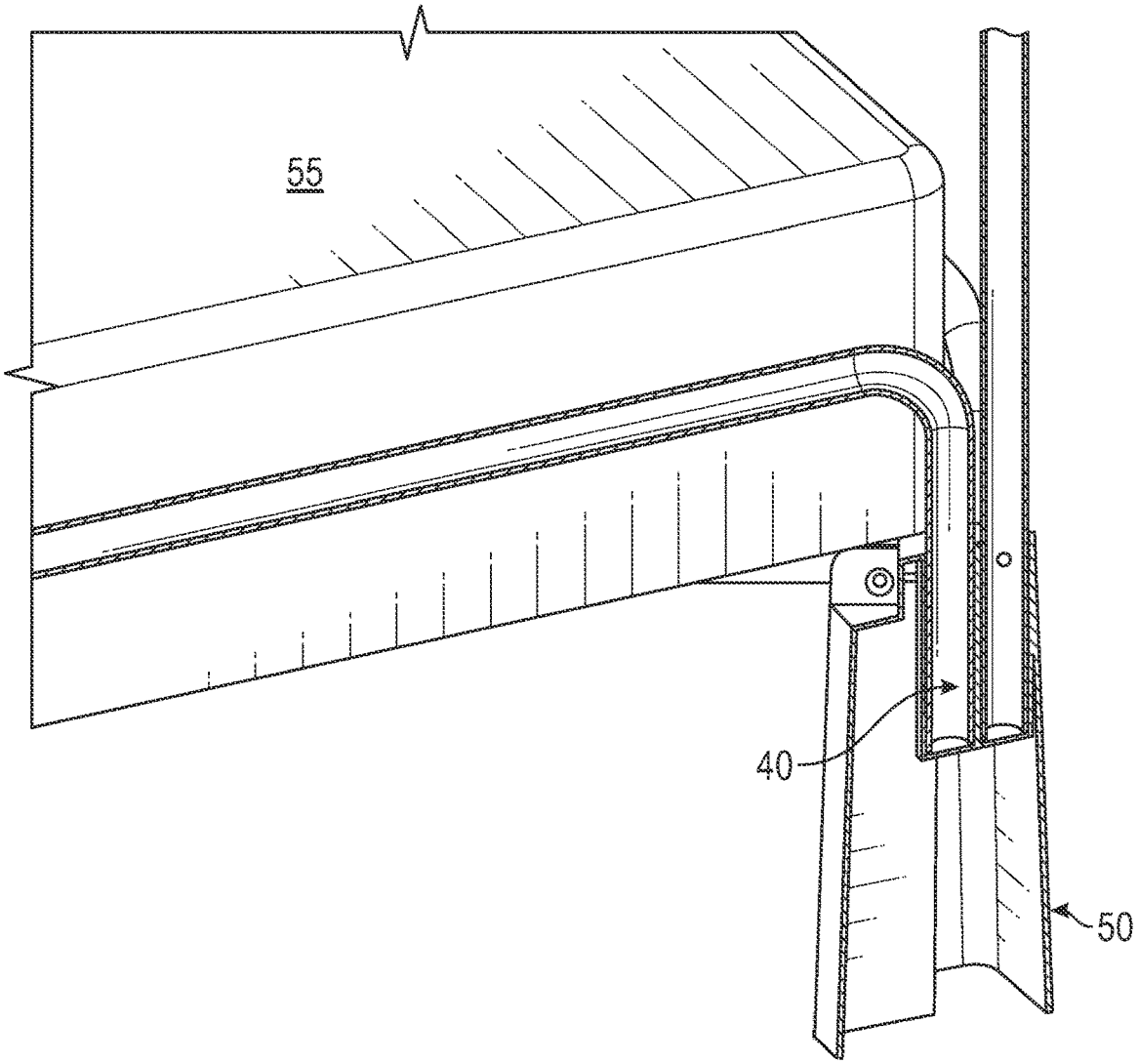
FIG. 6 shows a cross-sectional view of the portable play yard of FIG. 1 in accordance with aspects of the present disclosure.

Referring to FIG. 1, an embodiment of a play yard 10A (or crib) is shown. The play yard 10A comprises frame 11 (also known as an outer frame). The frame 11 includes a collapsible top assembly 20, a collapsible bottom assembly 30 and a perimeter frame 40. As shown, frame 11 includes four vertical posts 12 (also referred to herein as vertical supports). Each post has an upper 121 and lower end 122. The lower end of each post 12 is plugged/snapped into feet 50. Each foot of the feet 50 comprise, for example, Polypropylene or other suitably rigid material. FIG. 6 shows a cross-sectional view of the feet 50 in accordance with aspects of the present disclosure.

Continuing with FIG. 1, the collapsible top assembly 20 includes long/longitudinal top rail 21 and 23, and short (or lateral) top rails 22 and 24. Each long top rail comprises first and second rail members. Each first rail member is pivotally connected to a second rail member, e.g., via a hinge, to collectively provide a long top rail. Each short top rail 22, 24 has one end pivotally connected to a vertical post and a long top rail, and the other end pivotally connected to another vertical post and a long top rail.

As shown, the collapsible bottom assembly 30 includes four bottom rail members, including two cross support rails 31, 32 (also known as support rails). Each rail of the bottom assembly 30 includes an end coupled to locking rail joints, e.g., locking rail joint 25. The support rails are configured to underlie and support full-size mattress 55.

As further shown, the perimeter frame 40 includes four side rails, namely at least two long/longitudinal rails and two short (or lateral) rails that adjoin the long rails. Each rail of the perimeter frame 40 can comprise steel tubes, e.g., tubes 411 and 412. Each of tubes 411, 412 include a straight end and a right-angle end. The straight ends of 411 and 412 are coupled/connected to each other to collectively provide a long side rail. The right-angle ends then couple into feet 50, and preferably removably couple into feet 50.

The perimeter frame 40 defines/encompasses the full size baby crib dimensions. In an embodiment, the term full size in the context of a baby crib refers to an interior dimension of 28"+−⅝" wide and 52⅜"+−⅝" long. Preferably, the perimeter frame 40 does not fold/collapse and the same is simply removed for storage of the play yard 10A or travel purposes.

In an embodiment, all frames members of the play yard 10A are constructed using 0.750" diameter steel tubing. In another embodiment, the feet 50 may be designed to offset the bottom of the mattress 5-10" from the floor, and preferably 8" inches+−1".

The feet 50 may be injection molded via Polypropylene with added stiffening agent, e.g., talc or equivalent.

In one embodiment, a foldable frame with an integrated perimeter frame (also referred to herein as an integrated perimeter mattress frame) is configured with full size baby crib dimensions, which includes interior dimensions 28"+−⅝" wide and 52⅜"+−⅝" long. The integrated perimeter frame includes tubular frame members that attach/couple to feet (or supports), while being separate and distinct from the outer/wall frame. The integrated perimeter frame can fold with the outer/wall frame such that the same collapse into a single structure. Alternatively, the perimeter frame can be folded separately from the outer/wall frame. Preferably, a fabric cover (not shown) surrounds at least a portion of the perimeter frame such that the perimeter frame is obscured from user view, which is more clearly shown in FIG. 5.

Figure 2:
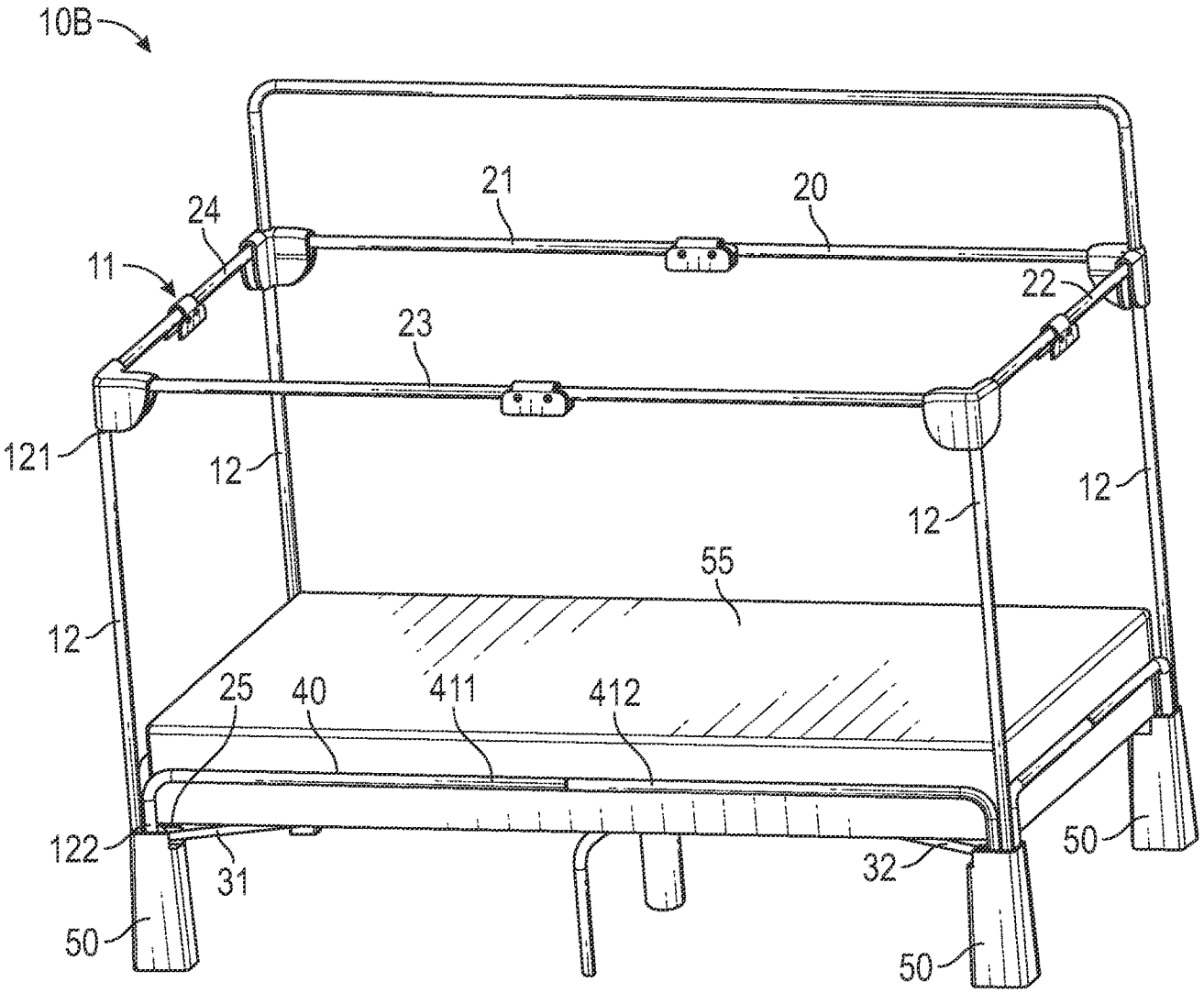
FIG. 2 shows another example portable play yard in accordance aspects of the present disclosure.

FIG. 2 shows another example embodiment of a play yard 10B. Like numerals indicate like elements. The play yard 10B is configured substantially similar to that of play yard 10A. However, as shown in FIG. 2, the perimeter frame is separable from frame 11. Preferably, the perimeter frame includes slidably coupled members that include a first tubular member having a cavity with a first inner diameter, and a second tubular member having an outer diameter being less than the first inner diameter. Thus, the cavity of the first tubular member is configured to receive and couple to at least a portion of the second tubular member.

In an embodiment, the play yard 10B of FIG. 2 is at least partially formed/assembled by a user. Each side includes, for example, 2 steel tubes (~0.75" diameter) assembled to each other by the user and then each tube subassembly, e.g., four (4) in total, are plugged/snapped into the feet 50. This perimeter frame defines/encompasses the full size baby crib dimensions which generally includes: interior dimensions 28"+−⅝" wide and 52⅜"+−⅝" long. In this scenario, the perimeter frame 40 does not fold and can be removed to allow for folding/collapsing of the crib for storage/travel. Alternatively, the perimeter frame 40 can be configured to fold/collapse with the frame 11 and/or separately from the frame 11.

Figure 3:
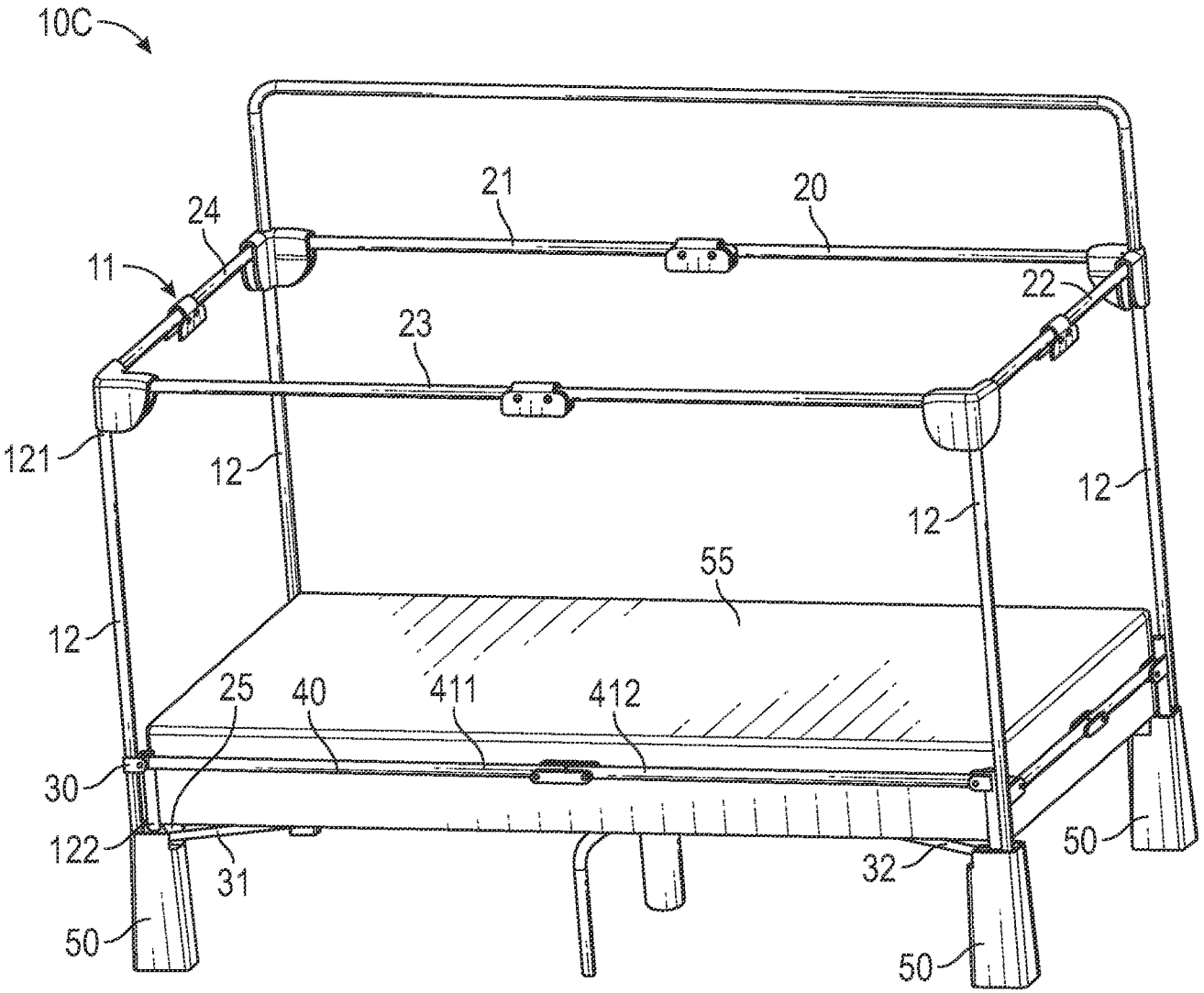
FIG. 3 shows another example portable play yard in accordance with aspects of the present disclosure.

FIG. 3 shows another example embodiment of a play yard 10C. The play yard 10C is configured substantially similar to that of play yards 10A and 10B of FIGS. 1 and 2, respectively. Like numerals indicate like elements. However, as shown in FIG. 3, the perimeter frame 40 includes tubular members that attach to the vertical supports of frame 11. In this example, the play yard 10C includes full size baby crib dimensions which generally includes: interior dimensions of 28"+−⅝" wide and 52⅜"+−⅝" long. Preferably, perimeter frame 40 attaches directly to the existing vertical tubes of the frame 11, and is configured to fold in tandem with the same. Similar to FIGS. 1 and 2, play yards 10A/10B can include a fabric cover that at least partially surrounds perimeter frame 40 and obscured the same from user view (see FIG. 5).

Figure 4:
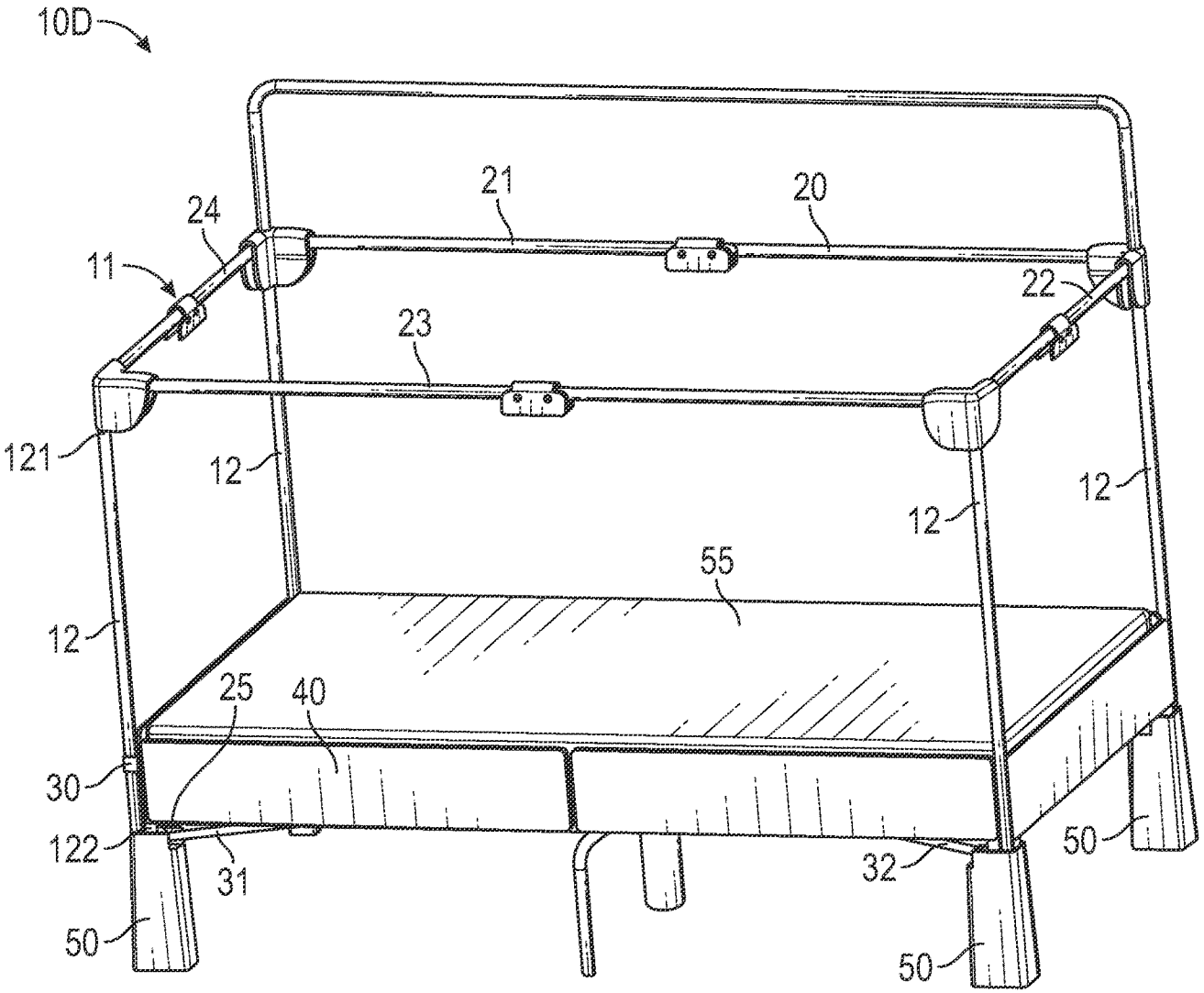
FIG. 4 shows another example portable play yard in accordance with aspects of the present disclosure.

FIG. 4 shows another example embodiment of a play yard 10D. Like numerals indicate like elements. The play yard 10D is configured substantially similar to that of play yards 10A-10C. However, as shown in FIG. 4, the perimeter frame 40' includes a long rail formed from one or more panels of a rigid material. In an embodiment, the rigid material comprises MDF panels or panels formed from other materials such as plastic or wood. The perimeter frame 40' may be at least partially assembled by a user. For instance, each long-side of perimeter frame 40' can include two or more MDF boards, such as shown, which can be inserted into pockets of the fabric cover (not shown) forming the sidewalls. The pockets of the fabric cover may be configured to at least partially surround, and preferably completely surround, the perimeter frame 40', and more specifically, the panels forming perimeter frame 40'.

The perimeter frame 40' can include dimensions that comport with standard full size baby cribs. For instance, the play yard 10C an include interior dimensions 28"+−⅝" wide and 52⅜"+−⅝" long. Preferably, the perimeter frame does not fold and can be removed from play yard 10D to fold the crib for storage and travel.

Figure 5:
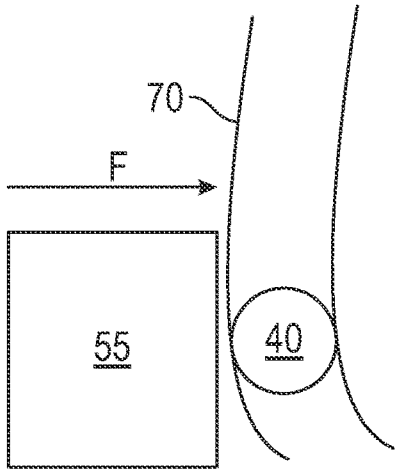
FIG. 5 shows an example fabric cover at least partially surrounding a perimeter frame in accordance with aspects of the present disclosure.

FIG. 5 show an example embodiment consistent with the present disclosure. As shown in FIG. 5, fabric cover 70, perimeter frame 40, and mattress 55 include exaggerated dimensions. The fabric cover 70 at least partially surrounds tubular members of frame 40. Preferably, fabric cover 70 fully surrounds tubular members of frame 40 to obscure the same from a user's view. The mattress 55 includes an outer perimeter that includes a predefined offset distance with perimeter frame 40. In an embodiment, the predefined offset distance is less than 1 inch, and preferably less than 0.5 inches.

As further shown, a force F applied can be applied (e.g., by a baby/infant) against the fabric sidewall provided by the fabric cover 70. The force F may cause 'flex' or displacement of the sidewall formed by fabric cover 70, but the predefined distance between perimeter frame 40 and the mattress 55 remains constant, thus preventing a gap to form there between.

Standards for folding infant beds exist, and generally mandate that play yards must have: side rails that do not form a sharp V when the product is folded, which prevents a child from strangling in the side rail, stronger corner brackets to prevent sharp-edged cracks and to prevent a side-rail collapse, and sturdier mattress attachments to the play yard floor to prevent children from getting trapped or hurt. Since the Cribs are traditionally cumbersome to set up and are often not easy to move from room to room once set up. Traditional play yards offer portability but do not accept full size crib mattress or anything thicker than 1.5".

A portable play yard configured consistent with the following disclosure allows for full size mattresses (e.g., having thicknesses greater than 1.5", e.g., at least 2", and preferably at least 3") to be utilized without introducing dangerous conditions.

This crib features a foldable tubular frame that accepts a full size crib mattress and breathable mesh panels. The internal concentric frame defines the size of the crib (which is mandated ASTM F1169 Full Size Baby Crib standard). The size of mattresses is also mandated. This leaves a slight gap between the mattress and the mesh panels. Because our fabric cover is flexible (unlike a wooden or steel crib slats), the design of this crib features a tubular perimeter, which is captured in the fabric of the crib cover that surrounds the mattress, to minimize any gapping created by the flexibility of the mesh and the mattress. This tubular structure can fold with the crib or alternatives include a consumer assembled tubular structure (or rigid material such as MDF) after crib assembly.

In accordance with an aspect of the present disclosure a portable play yard to receive and support a full-size crib mattress is disclosed. The portable play yard comprises a frame configured to define crib sidewalls when at least partially covered by a fabric cover, the frame including support rails to couple to a full-size crib mattress, and a perimeter frame coupled to the frame, the perimeter frame surrounding at least a portion of the full-size crib mattress and is disposed at a predefined distance from the full-size crib mattress when the full-size crib mattress couples to the frame.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. It will be appreciated by a person skilled in the art that a bed consistent with the present disclosure may embody any one or more of the features contained herein and that the features may be used in any particular combination or sub-combination. Modifications and substitutions by one of ordinary skill in the art are considered to be within the scope of the present disclosure, which is not to be limited except by the claims.

What is claimed is:

1. A portable crib comprising:

a full-size crib mattress having an upper and a lower surface, the full-size crib mattress having interior dimensions of 28"+/−⅝" wide and 52⅜"+/−⅝" long;

a fabric cover; and a frame configured to be at least partially covered by the fabric cover to define crib sidewalls, the frame including a collapsible top assembly including top rails, four vertical posts, four feet, each of the four feet being coupled to different associated one of the four vertical posts, a collapsible bottom assembly including support rails to support the full-size crib mattress, and a perimeter frame at least partially surrounded by the fabric cover to define at least a portion of the crib sidewall, the perimeter frame disposed horizontally between the four vertical posts, the perimeter frame configured to extend around the perimeter of the full-size crib mattress and configured to be disposed between the upper and the lower surfaces of the full-size crib mattress at a predefined horizontal distance between an outer perimeter of the full-size crib mattress and the perimeter frame when the full-size crib mattress is supported by the support rails, wherein the predefined horizontal distance is less than 1 inch and the predefined horizontal distance remains constant when a force is applied to the fabric cover of the sidewall, wherein the perimeter frame includes four rails, each rail of the four rails having a straight portion and first and second angled ends positioned substantially at a right angle to the straight portion, the first and second angled ends being coupled to different associated ones of the four feet and to different associated ones of the four vertical posts.

2. The portable crib of claim 1, wherein the frame is configured to fold in order to transition from an in-use to a storage configuration.

3. The portable crib of claim 1, wherein the full-size crib mattress includes a thickness of at least 4 inches.

4. The portable crib of claim 1, wherein the frame couples to the perimeter frame via a foot.

5. The portable crib of claim 4, wherein the foot comprises polypropylene.

6. The portable crib of claim 1, wherein the perimeter frame couples directly to the frame.

7. The portable crib of claim 6, wherein the frame includes vertical supports, and wherein the perimeter frame directly couples to the frame by way of the vertical supports.

8. The portable crib of claim 1, wherein the perimeter frame is configured to fold or collapse.

9. The portable crib of claim 8, wherein the perimeter frame and the frame are configured to fold while coupled to each other.

10. The portable crib of claim 1, further comprising the fabric cover, the fabric cover surrounding at least a portion of the perimeter frame.

11. The portable crib of claim 1, wherein the perimeter frame is removable from the frame.

12. The portable crib of claim 1, wherein the perimeter frame comprises panels formed of MDF.

13. The portable crib of claim 1, wherein the frame includes an interior dimension of 28"+/−⅝" wide and 52⅜"+/−⅝" long.

14. The portable crib of claim 1, wherein the full-size crib mattress includes a length of 27.25 inches, a width of 51.25 inches and a thickness less than or equal to 6 inches.

15. The portable crib of claim 1, wherein the first and second angle ends are removably coupled to the different associated ones of the four feet.

16. The portable crib of claim 1, wherein the first and second angle ends are removably coupled to the different associated ones of the four vertical posts.

* * * * *